US007114753B2

(12) United States Patent
Nodorft

(10) Patent No.: US 7,114,753 B2
(45) Date of Patent: Oct. 3, 2006

(54) LATCH ASSEMBLY FOR A SECTIONAL DOOR

(75) Inventor: Jeff Nodorft, Sauk City, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/781,038

(22) Filed: Feb. 9, 2001

(65) Prior Publication Data

US 2002/0109359 A1 Aug. 15, 2002

(51) Int. Cl.
*E05C 1/02* (2006.01)

(52) U.S. Cl. ..... 292/137; 292/139; 292/145; 292/146; 292/150; 292/DIG. 36; 160/201; 160/290.1

(58) Field of Classification Search ..... 160/201, 160/207, 290.1; 292/137, 138, 141, 145, 292/146, DIG. 15, DIG. 36, DIG. 19, 3, 292/139, 140, 150, DIG. 26; 49/199, 197, 49/25, 26, 322

See application file for complete search history.

(56) References Cited

U.S. PATENT DOCUMENTS

| | | | | |
|---|---|---|---|---|
| 1,532,987 | A | 4/1925 | Bumgarner | |
| 1,908,165 | A * | 5/1933 | Moler | 160/113 |
| 2,064,470 | A | 12/1936 | Heckman | |
| 2,095,695 | A | 10/1937 | Greegor | |
| 2,185,828 | A | 1/1940 | Blodgett | |
| 2,651,817 | A | 9/1953 | Moler | |
| 2,703,247 | A | 3/1955 | Wolf et al. | |
| 2,770,005 | A | 11/1956 | Smith | |
| 2,869,183 | A | 1/1959 | Smith | |
| 3,188,698 | A | 6/1965 | Zoll et al. | |
| 3,258,062 | A | 6/1966 | Lambert | |
| 3,276,165 | A | 10/1966 | Purcell | |
| 3,426,829 | A | 2/1969 | McDaniel et al. | |
| 3,579,910 | A | 5/1971 | Wetter | |
| 3,635,277 | A | 1/1972 | Bahnsen | |
| 3,747,274 | A | 7/1973 | Moorman et al. | |

(Continued)

FOREIGN PATENT DOCUMENTS

FR 2 746 842 A 10/1997

(Continued)

OTHER PUBLICATIONS

Photographs of Section Saver™ Door Ratchet.
International Search Report from PCT/US02/03755.

*Primary Examiner*—Brian E. Glessner
*Assistant Examiner*—Carlos Lugo
(74) *Attorney, Agent, or Firm*—Hanley Flight & Zimmerman LLC

(57) ABSTRACT

A door-latching system for a sectional door with multiple door panels helps hold the door at its fully open position in case the door's counterweight torsion spring fails to do so. The door-latching system includes a latch assembly that moves between a maintained release position and a door-blocking position. In the door-blocking position, the latch assembly helps hold the door open by providing an obstruction to the door panels. In the maintained release position, the latch assembly allows the door to move freely between open and closed positions without the door-latching system clacking as the door panels or their guide rollers travel past the latch assembly. Movement of the door panels automatically shifts the latch assembly from its release position to its door-blocking position, and manual actuation returns the latch assembly back to its release position. The latch assembly is especially suited for mounting to a track that guides the movement of the door panels.

49 Claims, 10 Drawing Sheets

U.S. PATENT DOCUMENTS

| | | | | | |
|---|---|---|---|---|---|
| 3,933,382 | A | * | 1/1976 | Counts et al. | 292/144 |
| 3,996,591 | A | * | 12/1976 | Hayward | 292/3 |
| 4,080,757 | A | * | 3/1978 | Westerman | 49/322 |
| 4,385,471 | A | * | 5/1983 | Gabry et al. | 49/322 |
| 4,443,033 | A | * | 4/1984 | D'Anna | 292/235 |
| 4,502,246 | A | | 3/1985 | Minami | |
| 4,520,591 | A | | 6/1985 | Calvagno | |
| 4,604,828 | A | | 8/1986 | Baarse | |
| 4,618,177 | A | * | 10/1986 | Schultz | 292/338 |
| 4,884,831 | A | * | 12/1989 | Emon | 292/38 |
| 4,996,795 | A | * | 3/1991 | Niswonger | 49/280 |
| 5,001,861 | A | * | 3/1991 | Hahn | 49/280 |
| 5,022,691 | A | | 6/1991 | Clay, Jr. | |
| 5,271,183 | A | | 12/1993 | Hahn et al. | |
| 5,271,448 | A | * | 12/1993 | Delgado | 160/265 |
| 5,291,686 | A | | 3/1994 | Sears et al. | |
| 5,489,130 | A | * | 2/1996 | Clark | 292/66 |
| 5,533,561 | A | * | 7/1996 | Forehand, IV | 160/188 |
| 5,683,124 | A | * | 11/1997 | Karpisek | 292/143 |
| 5,704,663 | A | | 1/1998 | Clay, Jr. | |
| 5,720,333 | A | | 2/1998 | Turvey | |
| 6,024,155 | A | | 2/2000 | Sharp | |
| 6,042,158 | A | * | 3/2000 | Horn | 292/165 |
| 6,145,570 | A | * | 11/2000 | Mullet et al. | 160/191 |
| 6,325,134 | B1 | | 12/2001 | Mullet | |
| 6,382,005 | B1 | * | 5/2002 | White et al. | 70/277 |

FOREIGN PATENT DOCUMENTS

| | | |
|---|---|---|
| GB | 8075 | 10/1914 |
| IT | 612296 | 11/1960 |
| NL | 7401386 | 8/1975 |
| SU | 220463 | 6/1966 |
| SU | 819033 | 4/1981 |
| WO | WO 85/01543 | 4/1985 |
| WO | WO 88/01000 | 2/1988 |
| WO | WO 88/01002 | 2/1988 |

* cited by examiner

LATCH ASSEMBLY FOR A SECTIONAL DOOR

BACKGROUND OF THE INVENTION

1. Field of the Invention

The subject invention generally pertains to sectional doors and more specifically to a latch assembly for such a door.

2. Description of Related Art

A sectional door typically includes a series of panels whose adjacent horizontal edges are connected by hinges. As the door opens or closes, the door panels travel along two lateral tracks that, for some door styles, curve between horizontal and vertical. To close the door, the tracks guide the panels to a vertical position across the doorway. When the door opens, the hinges allow the panels to curve around onto horizontal sections of the tracks, where the door panels store horizontally overhead. For other door styles, the sectional door maintains a generally vertical, planar configuration and is stored more directly above the doorway. Such doors, regardless of their configuration, are often open and closed manually. To ease the operation of the door, a torsion spring is often used to counteract the weight of the door panels. Sectional doors are commonly used as residential garage doors; however, they are also often used in warehouses and other industrial buildings.

When used in high-traffic industrial applications, overhead-storing doors are very susceptible to being struck by large trucks, trailers, forklifts and other vehicles passing through the doorway. Collisions are often caused by a door's torsion spring becoming weak with age or not being properly preloaded, which can allow a door to droop or not stay in its fully open position. Consequently, an upper edge of a vehicle may catch the lower edge of the door, and thus break or damage the door.

Holding a sectional door fully open without relying solely on the door's torsion spring can be accomplished by a safety catch disclosed in U.S. Pat. No. 3,426,829. Such a catch includes a spring that urges the catch to an extended position. In this position, the catch is able to engage the underside of a roller or its shaft to prevent the door from accidentally falling down to its closed position. To release the door, a solenoid pulls on the catch. This rotates the catch out from underneath the roller, which allows the door to close. Such a device, however, has a few drawbacks.

For example, as the door opens, several rollers or their shafts repeatedly snap the catch between its extended position and a release position, as the rollers or their shafts travel past the catch. The wasted snapping movement of the catch can create noise, as well as create wear on various parts of the door and wear on the catch itself. Moreover, to release the door out from underneath the catch, the catch rotates in such a way as to first raise the door panels slightly before allowing them to descend. Thus, the weight of the door could add significantly to the force needed in moving the catch to its release position.

SUMMARY OF THE INVENTION

In order to help hold the door panels of a sectional door at their fully open position, a latch assembly is mounted adjacent to the door. In response to movement of the door panels, the latch assembly moves from a maintained release position to a maintained door-blocking position. In the door-blocking position, the latch assembly helps hold the door open by providing an obstruction to movement of the door panels toward the closed position. In the release position, the latch assembly allows the door panels to move freely between the door panels' open and closed positions.

In some embodiments, the position of the door is sensed, and the latch assembly moves from the maintained release position to the maintained door-blocking position when it is sensed that the door is at or approaching the open position.

In some embodiments, the sensing of the door position is achieved, at least in part, by a traveling member coupled to the door for movement therewith.

In some embodiments, the traveling member is a protrusion mounted to the door or a panel thereof.

In some embodiments, the movement of the latch assembly from a release position to a door-blocking position is triggered by the traveling member.

In some embodiments, the motive force for movement of the latch assembly from a release position to a door-blocking position is provided by the movement of the protrusion with the door.

In some embodiments, the protrusion is mounted so as to be movable relative to the door panels so that the protrusion does not interfere with the latch assembly as the door closes.

In some embodiments, a latch assembly is added to help hold the door closed, wherein the second latch assembly also moves to a door-blocking position in response to movement of the door panels.

In some embodiments, a latch member of the latch assembly moves linearly from its door-blocking position to its release position to minimize the force needed to move the latch member. The linear movement allows the latch member to retract without having to forcibly raise the door slightly in the process.

DESCRIPTION OF THE PREFERRED EMBODIMENT

Figure 1:
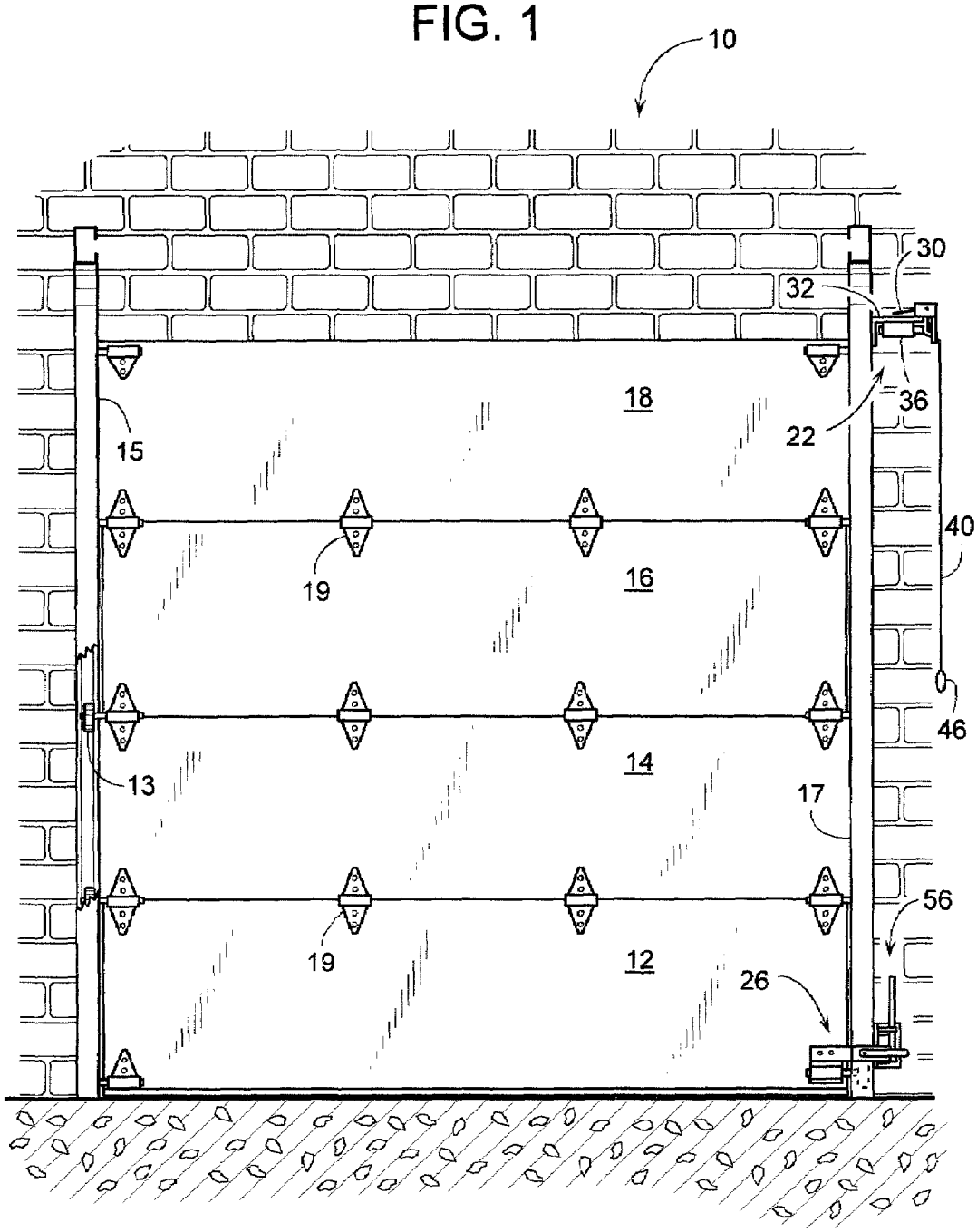
FIG. 1 is a front view of a sectional door with one embodiment of a door latch and with the door in a closed position.
Figure 2:
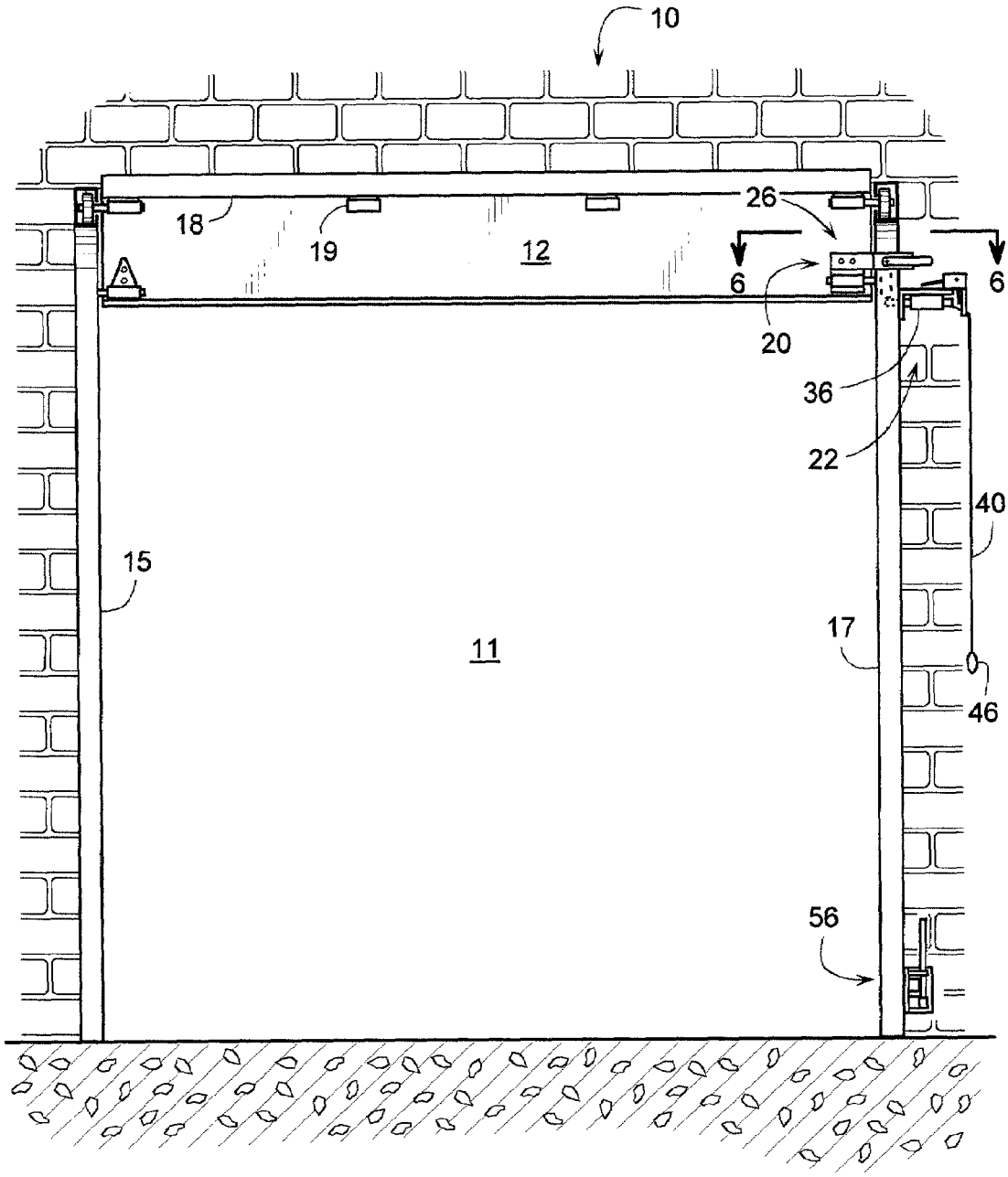
FIG. 2 is similar to FIG. 1, but with the door in an open position.
Figure 3:
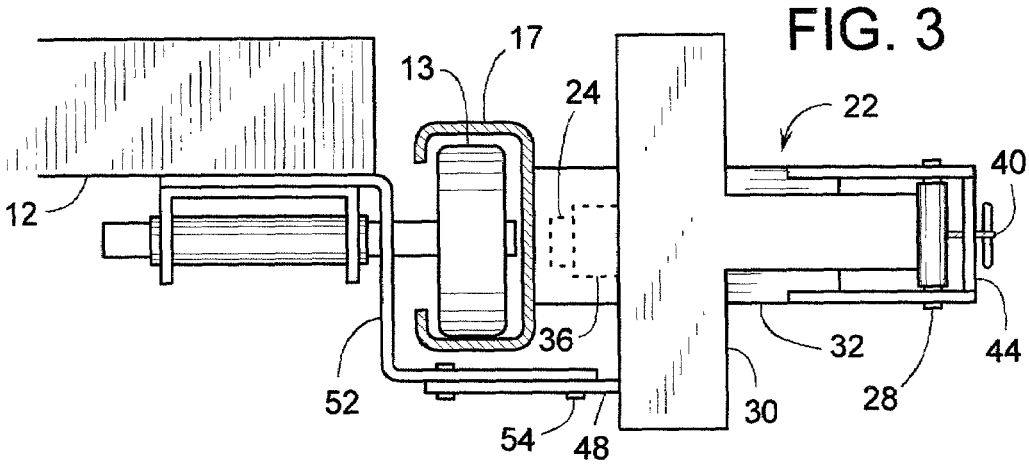
FIG. 3 is a top view of the latch assembly of FIGS. 1 and 2 with the door partially open.
Figure 4:
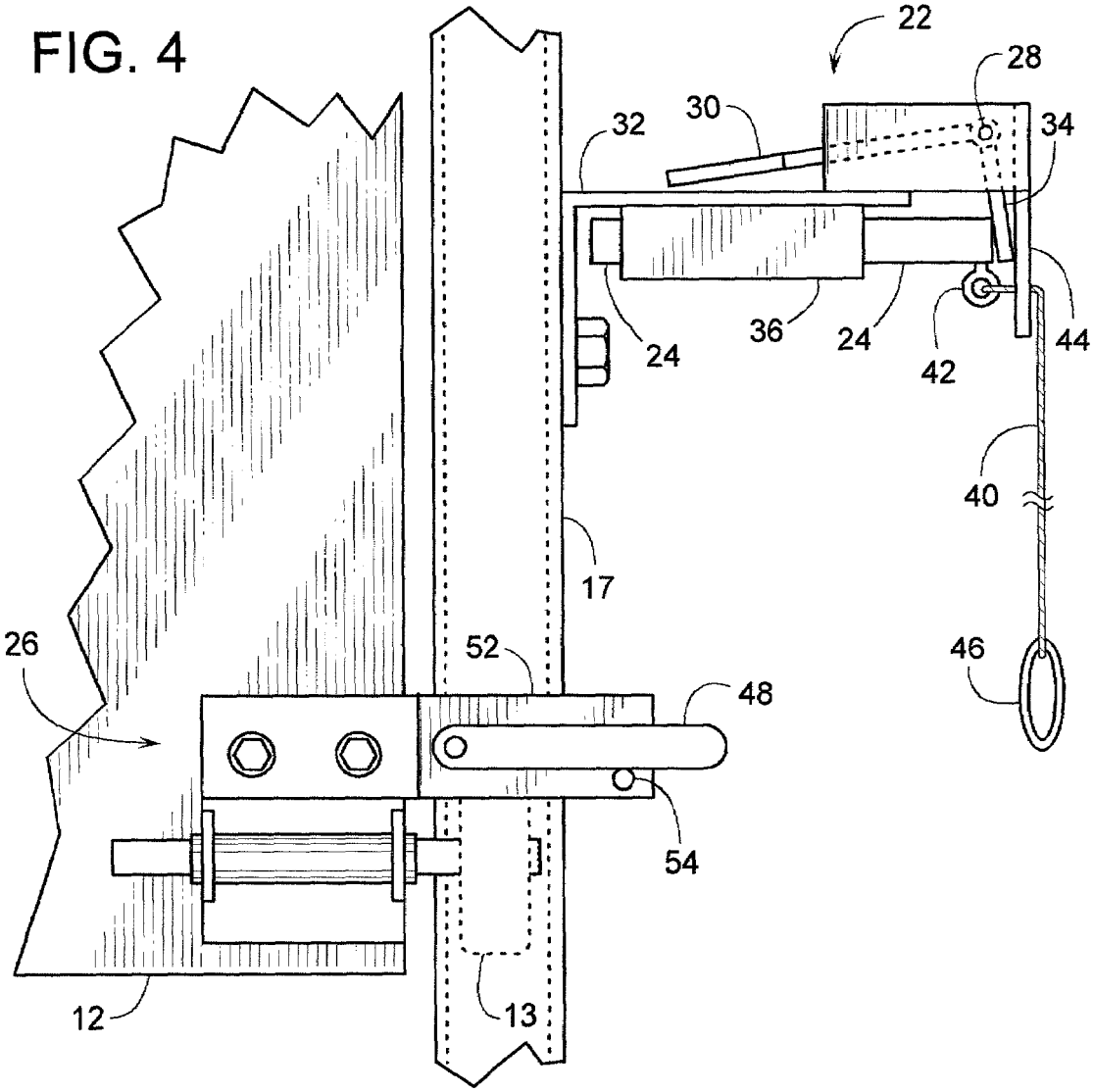
FIG. 4 is a front view of FIG. 3.
Figure 5:
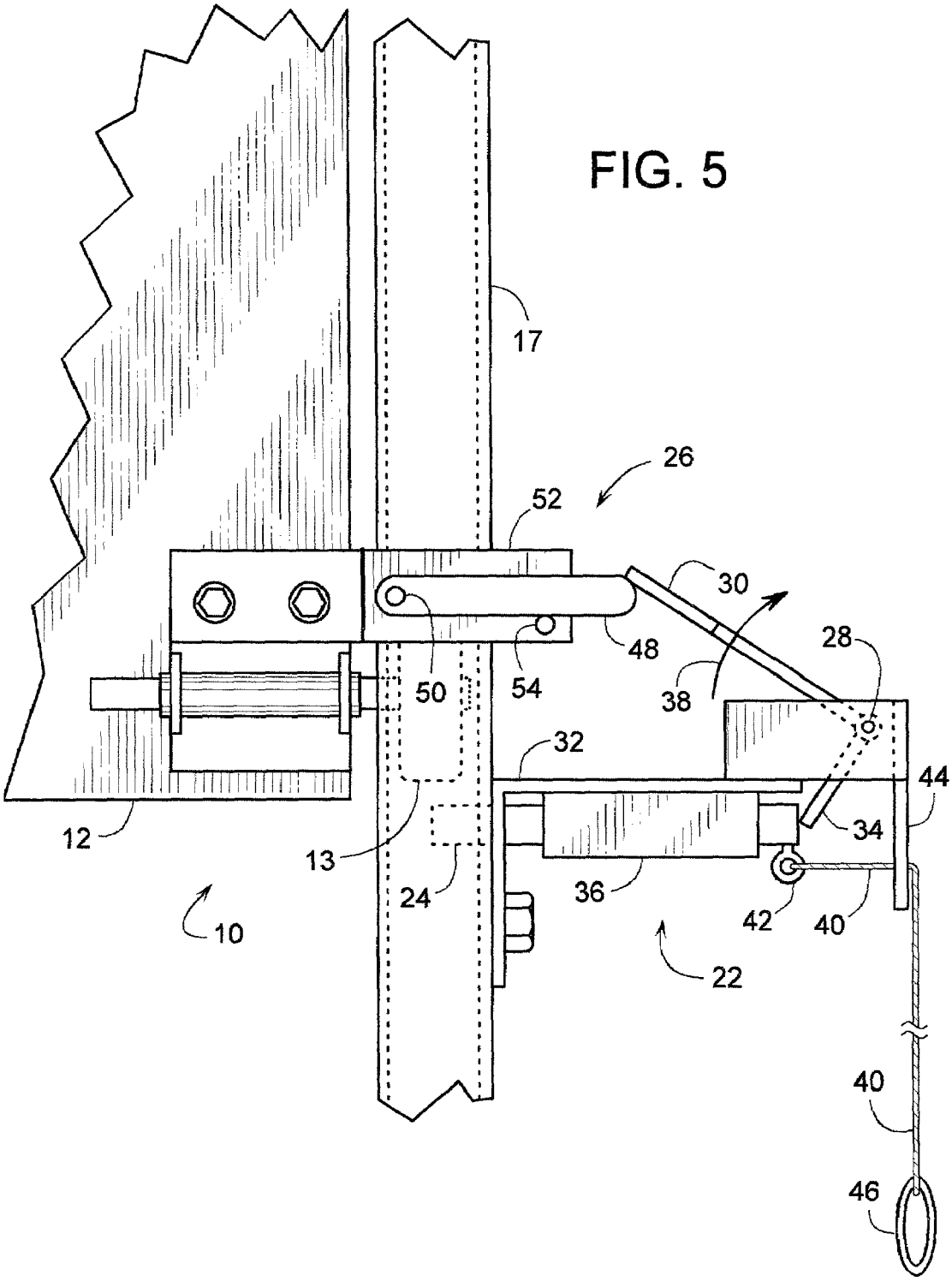
FIG. 5 is similar to FIG. 4, but with the door slightly above its fully open position.
Figure 6:
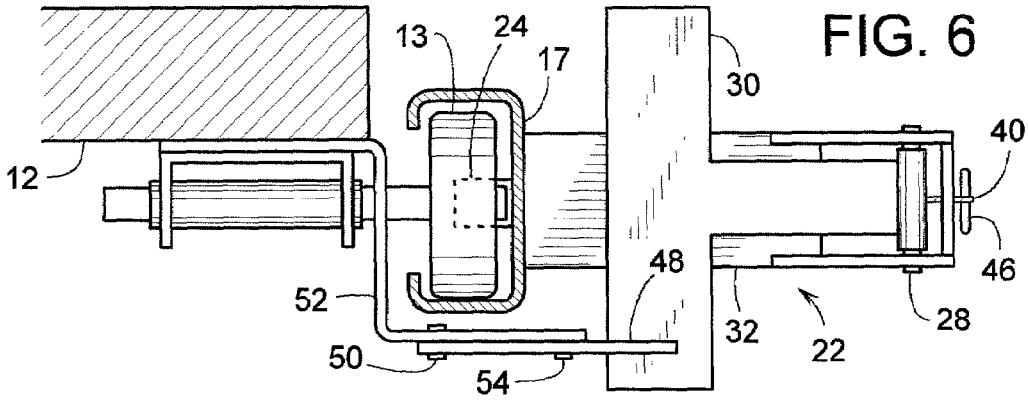
FIG. 6 is a cross-sectional top view taken along line 6—6 of FIG. 2.

A sectional door 10, shown closed in FIG. 1 and open in FIG. 2, includes a series of door panels 12, 14, 16 and 18 that are interconnected along their adjacent horizontal edges by hinges 19. As door 10 opens or closes relative to a doorway 11, guide members, such as rollers 13, guide the movement of the panels along two lateral tracks 15 and 17. In this example, tracks 15 and 17 curve between horizontal and vertical; however, it is well within the scope of the invention to have tracks 15 and 17 run generally linearly or only curve slightly, so that when the door opens, the door panels move above doorway 11, but remain in a generally vertical or slightly angled orientation. To close door 10, the vertical sections of tracks 15 and 17 guide the panels to a vertical position across doorway 11. When door 10 opens, hinges 19 allow the panels to curve around onto the horizontal sections of tracks 15 and 17, where the door panels store horizontally overhead.

Typically, a torsion spring or other form of counterbalance is used to help counteract the weight of the door panels and help hold door 10 open. Other times, however, a torsion spring is not used, or the spring may be broken, weak or out of adjustment. Thus, to help ensure that door 10 can be held at its fully open position, door 10 is provided with a door-latching system, which fundamentally includes a latch member, an actuating member, and a sensing member that detects when door 10 is generally open. In response to the sensing member determining that door 10 is open, the actuating member moves the latch member to a position that inhibits door 10 from closing or drooping below the door's fully open position. Such a door-latching system can assume a variety of structural configurations.

For example, in the embodiment of FIGS. 1–13, a door-latching system 20 comprises a latch assembly 22 that includes a latch member 24, an actuating member 34, and a sensing member 30. Latch assembly 22 has a release position, as shown in FIGS. 1, 3, 4 and 8, and a door-blocking position, as shown in FIGS. 2, 5, 6 and 7. In the door-blocking position, latch member 24 of assembly 22 creates an obstruction that blocks the downward movement of the door panels. In the release position, latch member 24 retracts to allow the door panels substantially free up and down movement.

Sensing member 30 is a T-shaped plate attached to a frame 32 of latch assembly 22. A pin 28 allows sensing member 30 to pivot relative to frame 32, while frame 32 is generally fixed with respect to track 17. To sense when door 10 is open, sensing member 30 extends out over an area where door 10 or some part on door 10 can strike and thus lift sensing member 30 as door 10 approaches its open position. In this case, a traveling member 26 attached to the right-hand side of door panel 12 is used to trip sensing member 30. Sensing member 30 being T-shaped allows latch assembly 22 to be mounted alongside track 15 or 17 for either a right-hand or left-hand installation.

Actuating member 34, in this case, is an integral extension of sensing member 30, whereby members 30 and 34 both pivot about pin 28. Alternatively, one could consider actuating member 34 and sensing member 30 to be coextensive—i.e. the generally l-shaped member pivotal about pin 28. However, in other embodiments, actuating member 34 and sensing member 30 are separate and distinct. Actuating member 34 is positioned to engage one end of latch member 24. Latch member 24, in turn, slides linearly within a sleeve 36, with sleeve 36 being attached to frame 32.

As door 10 approaches its fully open position, traveling member 26 strikes the underside of sensing member 30, which pivots sensing member 30 and actuating member 34 clockwise about pin 28. This causes actuating member 34 to push latch member 24 through an opening in the side of track 17. In the extended, door-blocking position, shown in FIG. 5, latch member 24 creates an obstruction underneath roller 13 that limits the downward movement of door 10.

To prevent door-latching system 20 from clacking as the panels of door 10 travel past upper latch assembly 22, the release position of latch assembly 22 is preferably a maintained position. In other words, as door 10 opens, latch member 24 remains retracted to avoid hitting the door panels or their rollers until door 10 is fully open. That is, the latch assembly does not assume its operative position until it is needed—until the door is in the open position. It is only when it is sensed that the door is generally open that the latch assembly assumes this position. In this embodiment, this can be accomplished by mounting a traveling member 26 to panel 12, such that traveling member 26 first triggers latch assembly 22 to extend latch member 24 when door 10 is at or near its open position.

Often, the panels of door 10 tend to travel above and beyond their fully open position, usually due to the momentum of the door panels as door 10 opens. To allow for this overshoot, in some embodiments, door-latching system 20 avoids the use of a solid stop that could abruptly force the door panels to an immediate, forceful stop at their fully open position. For example, if the door panels travel above their position of FIG. 5, sensing member 30 simply slips off the edge of traveling member 26 and falls back down to the position of FIG. 7, while roller 13 of door panel 12 descends a short distance to rest upon latch member 24.

Figure 8:
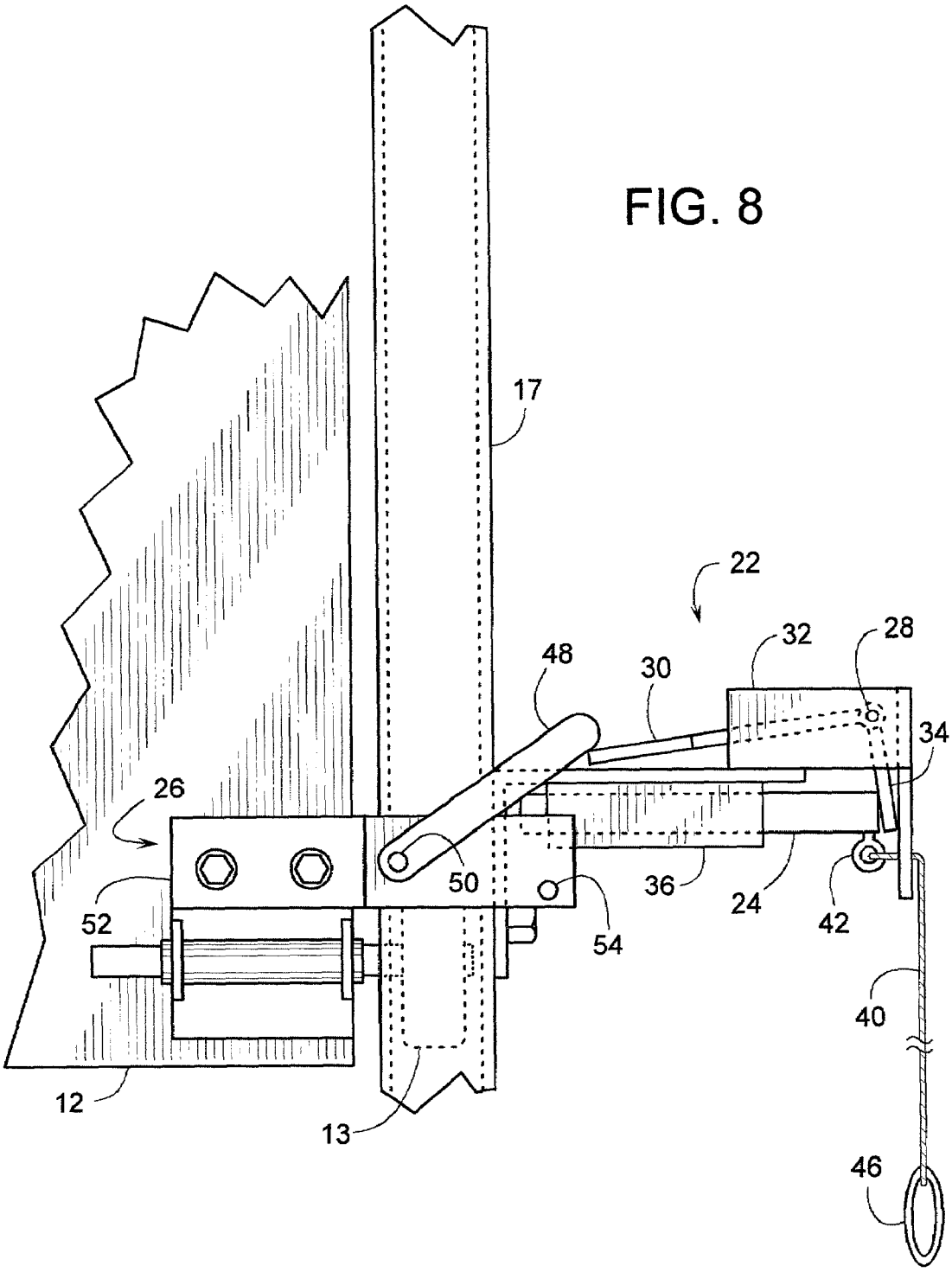
FIG. 8 is similar to FIG. 7, but with the door having descended slightly after the catch having moved to its release position.
Figure 9:
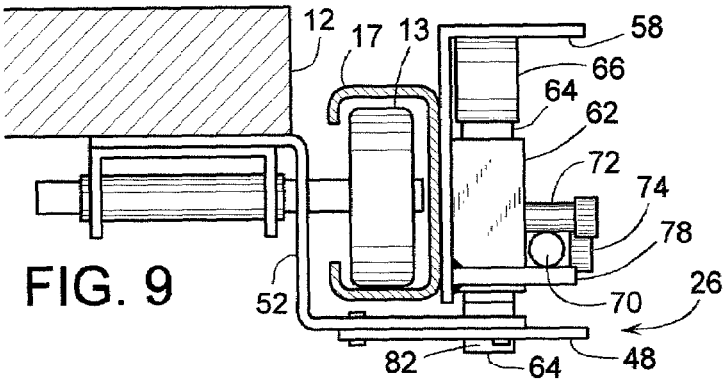
FIG. 9 is similar to FIGS. 3 and 6, but with the door approaching its closed position.
Figure 10:
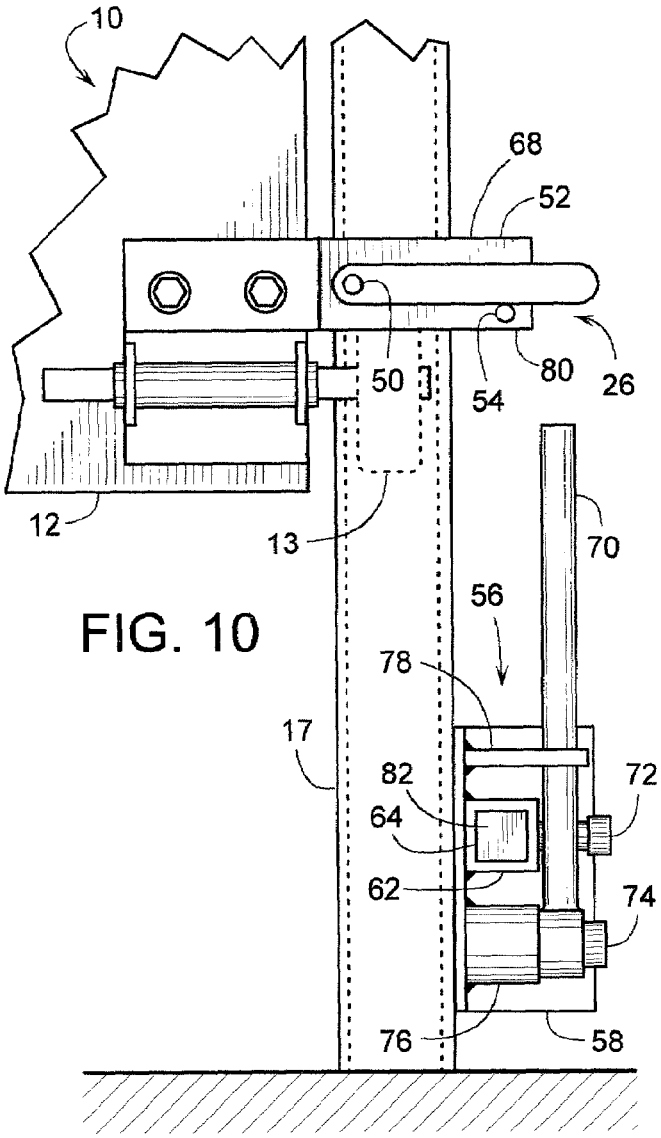
FIG. 10 is a front view of FIG. 9.
Figure 11:
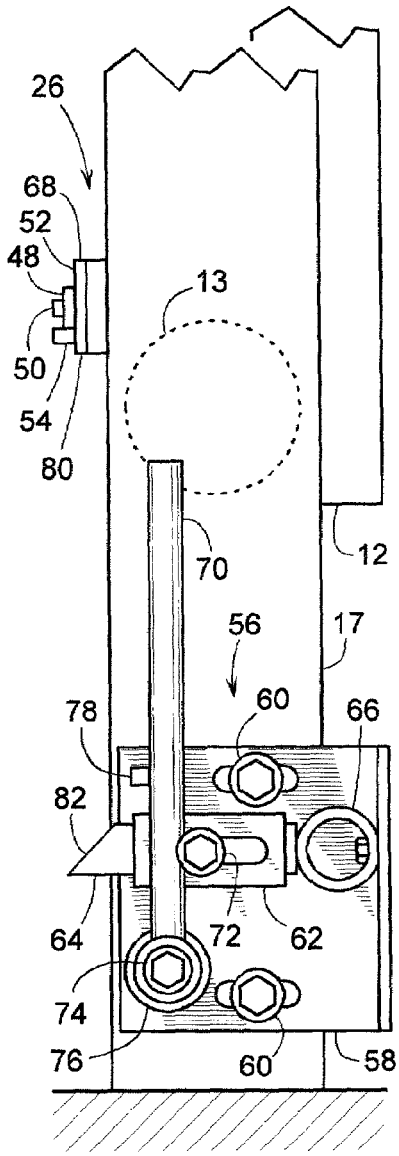
FIG. 11 is an end view of FIG. 10.
Figure 12:
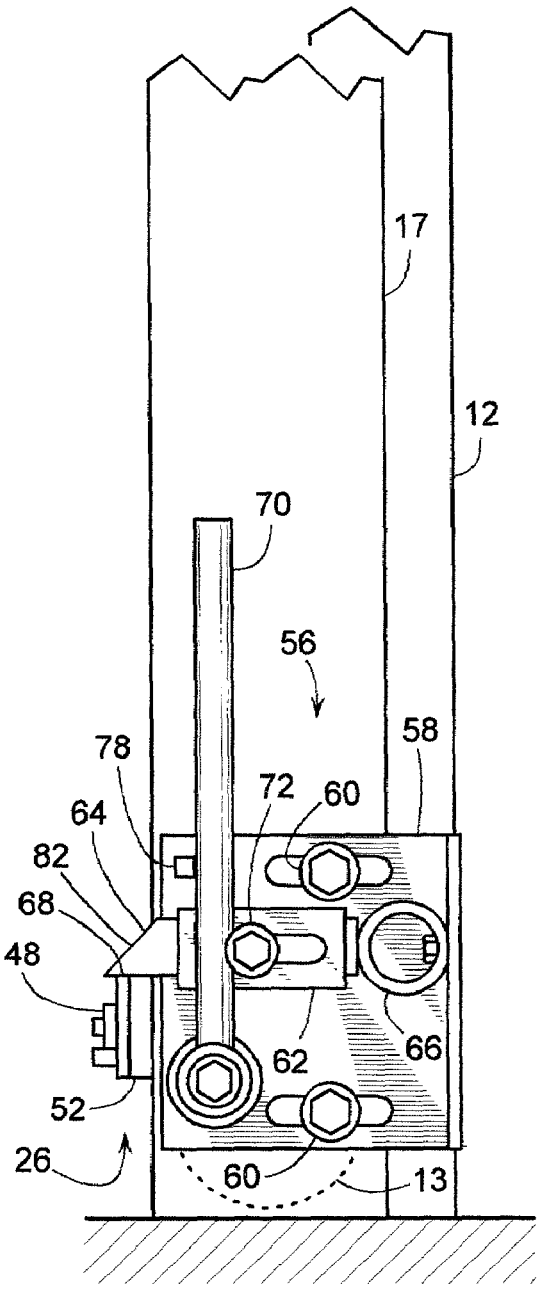
FIG. 12 is similar to FIG. 11, but with the door in its fully closed position and the a lower latch in its door-blocking position.

In order to close door 10, latch member 24 is retracted to the release position of FIG. 8. This removes the obstruction to roller 13, which allows the door to close. Retracting latch member 24 can be accomplished by a variety of powered or manually-operated mechanisms, such as, for example, a releasing member comprising a cord 40 or some other pliable elongated member attached to eyelet 42 on latch member 24. Cord 40 threads through a hole in an endplate 44 of frame 32, so that upon pulling downward on a lower end 46 of cord 40, the other end of cord 40 pulls latch member 24 out from underneath roller 13. To minimize the force needed to retract latch member 24, in some embodiments, the movement of latch member 24 is linear so that it does not lift roller 13 in the process of retracting.

Once latch member 24 is retracted to the release position of FIG. 8, roller 13 and the door panels are free to descend. So that traveling member 26 does not impede the downward movement of the door panels, traveling member 26 can be provided with a protruding pivotal arm 48 that can swing back as traveling member 26 descends past sensing member 30. For example, a pin 50 can pivotally attach arm 48 to a bracket 52 of traveling member 26. A second pin 54 attached to bracket 52 limits the downward pivotal movement of arm 48, so arm 48 can still trip sensing member 30 when door 10 opens. To prevent arm 48 from ever hanging pendant, arm 48 can be constrained to move between its horizontal position of FIG. 7 and an upwardly pointing vertical orientation by adding another pin or some other arm-engaging stop to bracket 52.

Referring to FIGS. 9–13, traveling member 26 can also be used in conjunction with a second latch assembly 56 for holding door 10 at its closed position. Latch assembly 56 includes a frame 58 attached to track 17 by way of fasteners 60. A sleeve 62 attached to frame 58 slidingly holds a bar 64.

Figure 13:
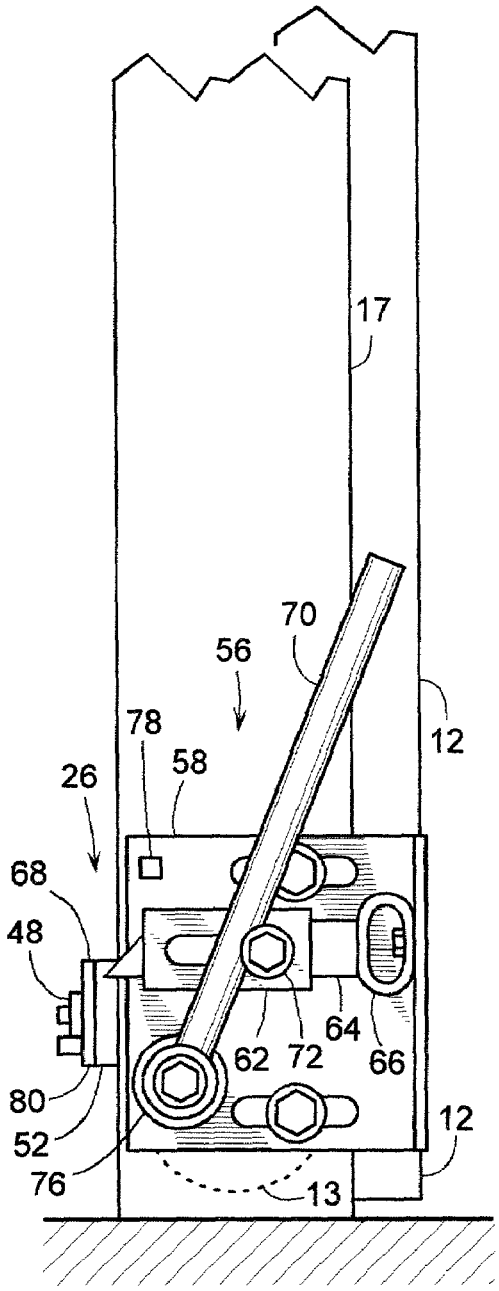
FIG. 13 is similar to FIG. 12, but with the lower latch in its release position and the door just starting to open.

To selectively hold and release door 10, bar 64 slides within sleeve 62 between a door-blocking position (FIGS. 1 and 12) and a release position (FIG. 13). A spring, such as a short section of flexible tube 66, biases bar 64 to the door-blocking position, where bar 64 extends over an upper edge 68 of bracket 52 when door 10 is closed. To release door 10, a pivotal lever 70 acting against the side of a screw 72 attached to bar 64 can be manually operated to push bar 64 back to its release position of FIG. 13. A threaded fastener 74, such as a shoulder screw or stripper bolt, attaches lever 70 pivotally to an internally threaded boss 76, which is welded to frame 58. An arm 78 extending from frame 58 prevents lever 70 from simply falling down against the floor.

In closing door 10, the descending door panels lower bracket 52 toward lower latch assembly 56. When traveling member 26 reaches bar 64, a lower edge 80 of bracket 52 pushes against a tapered face 82 of bar 64. This forces bar 64 to retract against the urging of spring 66 as door 10 continues closing. Upon door 10 reaching its fully closed position, spring 66 is able to push bar 64 out over edge 68 of bracket 52, thereby holding door 10 closed.

Figure 7:
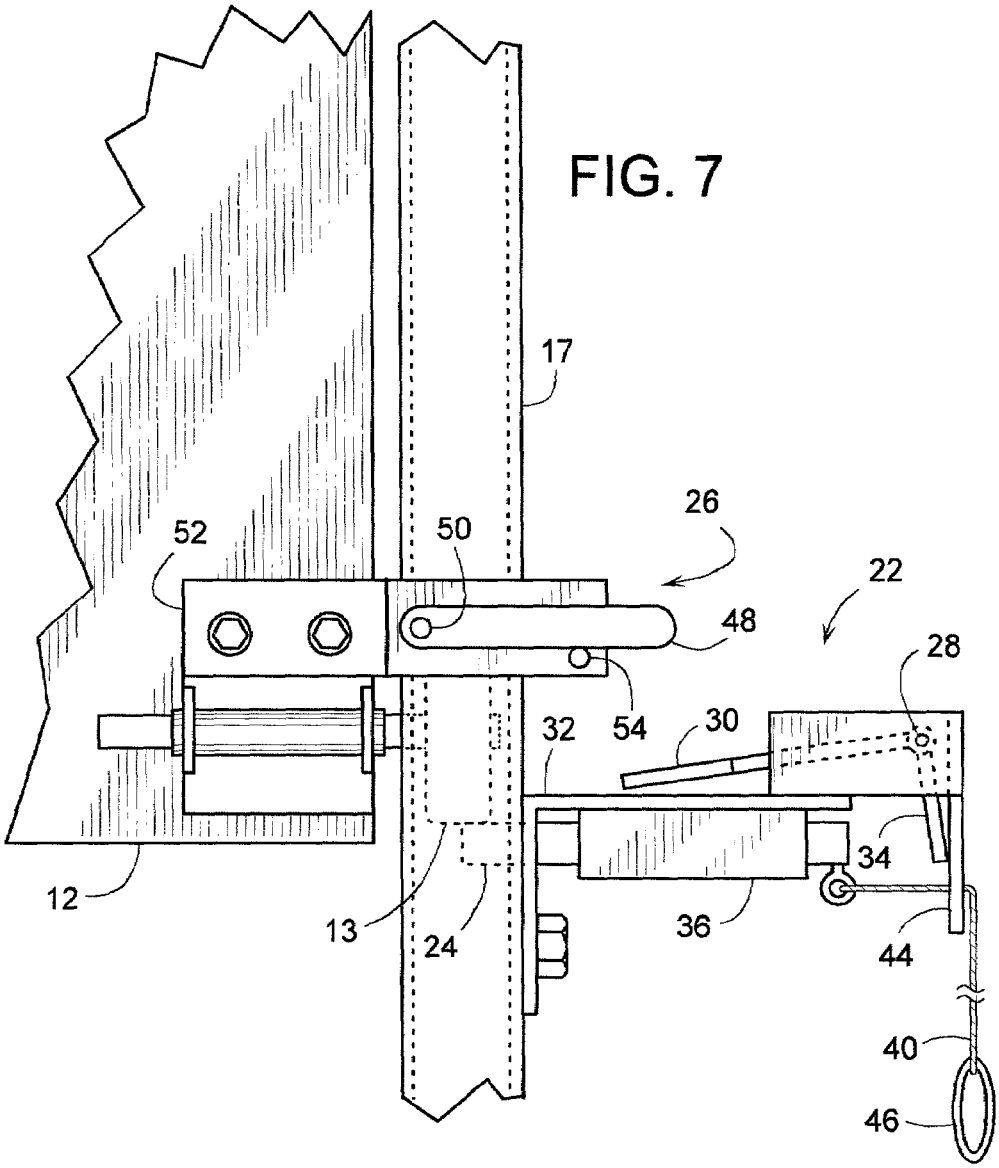
FIG. 7 is a front view of FIG. 6.

To open door 10, lever 70 is manually pushed against screw 72, which moves bar 64 back to its release position of FIG. 13. This allows door 10 to be lifted toward its open position. As the door panels ascend from their position of FIG. 4 to that of FIG. 5, arm 48 trips sensing member 30, which moves latch member 24 from its release position to its door-blocking position. After rising above sensing member 30, the door panels settle back down with roller 13 of panel 12 resting atop latch member 24, as shown in FIG. 7. It should be noted that spring 66 serves as a spring-return for returning bar 64 to its position of FIG. 11. It should also be noted that while second latch assembly 56 has been described in conjunction with use of traveling member 26, its use is not so limited. Rather, latch assembly 56 could be used with a variety of other traveling members or posts, etc. carried on the door—irrespective of whether such traveling member is associated with the latch assembly 22, above. Indeed, second latch assembly 56 need not even be disposed at the bottom of the door, and is advantageously placed waist-high.

To close door 10, pulling end 46 of cord 40 downward draws latch member 24 back out from underneath roller 13, which releases door 10.

Figure 14:
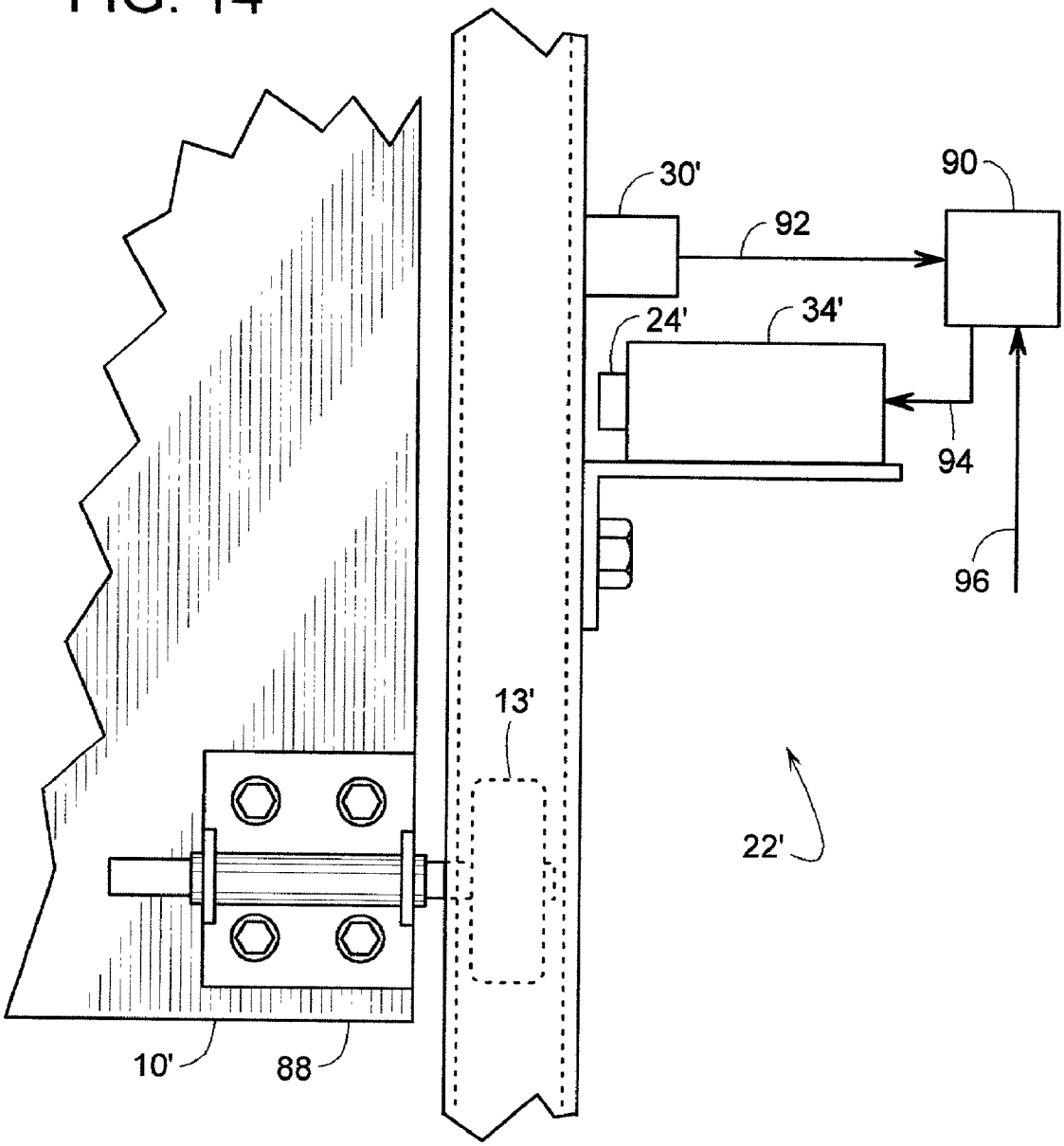
FIG. 14 is a front view of another exemplary door latching system in a release position.
Figure 15:
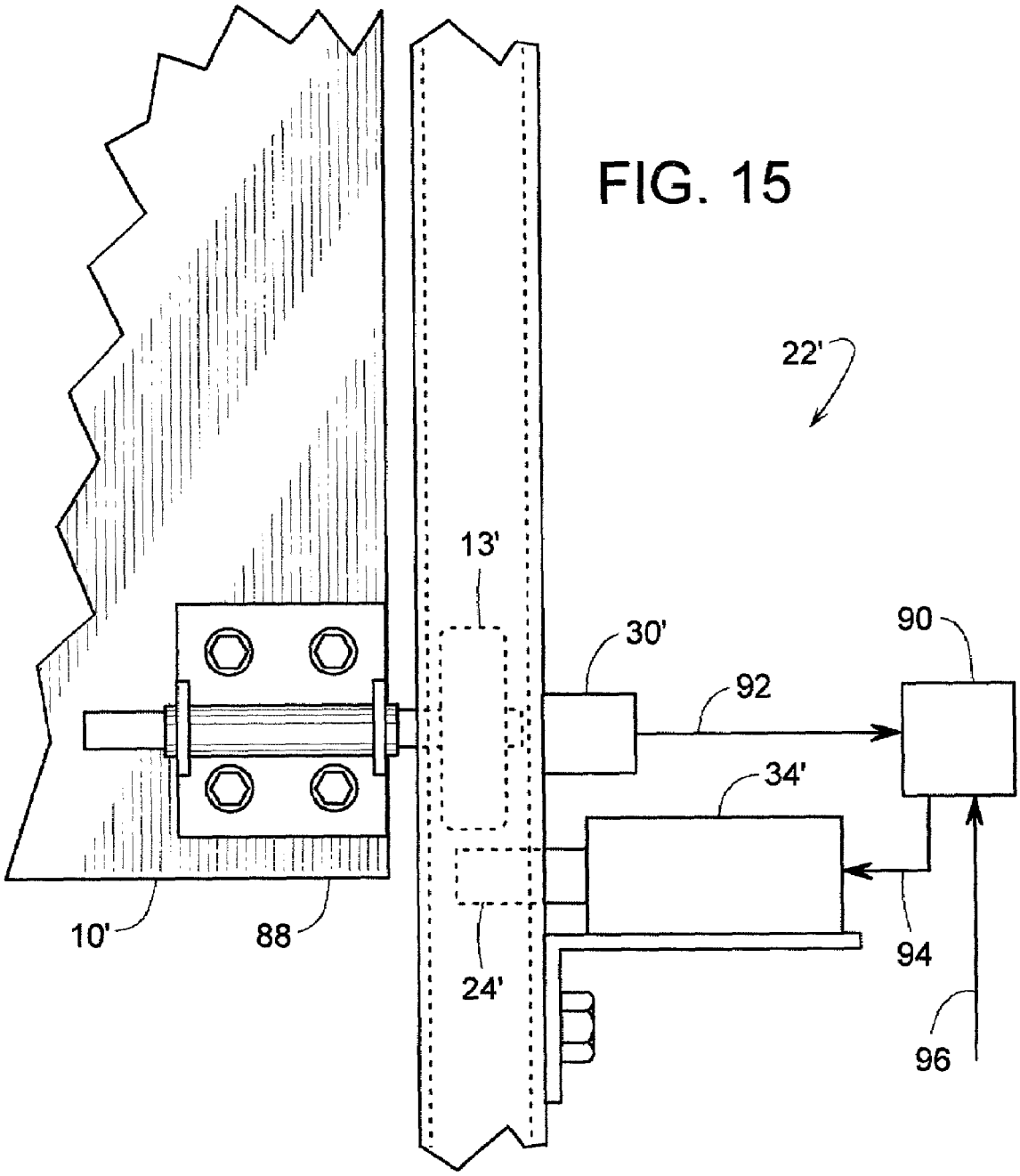
FIG. 15 is similar to FIG. 14, but with the door latching system in the door blocking position.

In another embodiment, shown in FIGS. 14 and 15, a door latching system includes a latch assembly 22' in the form of a latch member 24', an actuating member 34', and a sensing member 30'. Here, latch member 24' is preferably a moving core of a solenoid (or a mechanical extension thereof), but is schematically illustrated to represent any device for obstructing downward movement of a door 10'.

Actuating member 34' is preferably a coil of a solenoid, but is schematically illustrated to represent any device for moving latch member 24' between a release position (FIG. 14) and a door-blocking position (FIG. 15).

Sensing member 30' is schematically illustrated to represent any device for detecting when door 10' is at a predetermined open position. Examples of sensing member 10' include, but are not limited to, a mechanically actuated electric switch, a proximity switch and a photoelectric eye. Sensing member 30' can determine that door 10' is open by detecting that a certain feature of door 10' is at particular location. For example, a photoelectric eye or a mechanically actuated limit switch could detect when a lower edge 88 of door 10' or some other part on door 10' is adjacent sensing member 30', or a proximity switch could detect when a particularly unique door roller 13' (i.e., distinguishable from the others) or some other part on door 10' is adjacent sensing member 30'. In this sense, roller 13' equates with the traveling member 26 in the previous embodiments. The term, "photoelectric eye" refers to any device that provides an electric signal in response to a change in light. The term, "proximity switch" refers to any device that provides an electric signal in response to a change in an electric or magnetic field.

A control circuit 90 provides electrical communication between sensing member 30' and actuating member 34'. Control circuit 90 is schematically illustrated to represent any electrical link connecting sensing member 30' and actuating member 34'. Examples of control 90 include, but are not limited to, conventional hardwiring, radio transmission, a power source, electromechanical relays, circuits of integrated and/or discrete components, and various combinations thereof.

In operation, actuating member 34' places latch member 24' at its release position of FIG. 14. This allows door 10' to move up and down without any appreciable impedance from latch member 24'. When sensing member 30' detects that door 10' has reached a predetermined open position, sensing member 30' provides control 90 with an electrical signal 92. In response to signal 92, control 90 provides an output signal 94 that causes actuating member 34' to move latch member 24' (or allow it to move, e.g., powered extension and spring-return or vice versa) to its door-blocking position of FIG. 15.

To release door 10', control 90 can be given an input signal 96 that control 90 responds to by changing output signal 94. This causes latch member 24' to retract to its release position, which allows door 10' to close. Input signal 96 can be inputted to control 90 manually (e.g., a push button switch) or can be inputted in some other conventional manner.

While the embodiment of FIGS. 14 and 15 is depicted as using electrical components, it is additionally intended to generically represent the functions performed by the assembled components according to either this embodiment, or that of FIGS. 1–13, regardless of whether they are mechanical or electrical components. That is, latch members 24 and 24' can both be considered as means for retaining the door in the open position. A variety of other specific structures in addition to the post-like structures depicted herein can also perform this function —such as flat plates, hooks and the like—which can be moved between release and door-blocking positions. Similarly, both actuating members 34 and 34' can be considered as means for actuating the latch members (or means for retaining) to the door-blocking position. Other structures could perform this function (motors, springs, pistons, etc.) by providing or transmitting the necessary motive force to move the latch member to the door-blocking position. In the same vein, sensing members 30 and 30' can be considered as means for sensing the position of the door, or more specifically, a means for sensing that the door is in the generally open position. A variety of structures could perform this function, including those disclosed according to both embodiments herein. Accordingly, the door latching system depicted herein can alternatively be represented as a combination of structural components (latch member, actuating member, sensing member), or as a combination of functional blocks (means for retaining, means for actuating, means for sensing). In addition, the door latching system can also be identified by the method steps by which the advantageous latching function is performed.

Although the invention is described with reference to preferred embodiments, it should be appreciated by those skilled in the art that various modifications are well within the scope of the invention. For example, although latch member 24 obstructs roller 13, latch member 24 could be modified or relocated to create an obstruction to other parts associated with door 10, such as traveling member 26, a roller shaft, or a bottom edge of one of the door panels. Moreover, the upper and lower latch assemblies 22 and 56 can be used on the same door or used alone without the other. Therefore, the scope of the invention is to be determined by reference to the claims that follow.

I claim:

1. A door-latching system for a sectional door having a plurality of door panels that are moveable between an open position and a closed position, comprising:

a sensing member adapted to sense that the plurality of door panels have reached the open position;

a latch member mountable adjacent to the sectional door and being moveable from a maintained release position to a door-blocking position, wherein the latch member in the maintained release position allows at least some of the plurality of door panels to travel past the latch member, and in the door-blocking position the latch member inhibits the closing movement of the plurality of door panels; and a traveling member mountable to the plurality or door panels, such that the traveling member is able to move past the latch member without contacting the latch member as the plurality of door panels move from the closed position to the open position and such that the traveling member is able to engage the sensing member when the plurality of door panels have nearly reached the open position, wherein the traveling member engaging the sensing member causes the latch member to move from the maintained release position to the door-blocking position.

2. The door-latching system of claim 1, wherein the latch member in the door-blocking position obstructs downward movement of the plurality of door panels by engaging a guide roller associated with the sectional door.

3. The door-latching system of claim 1, further comprising a releasing member coupled to the latch member, such that the releasing member moves the latch member from the door-blocking position to the maintained release position upon manual manipulation of the releasing member.

4. The door-latching system of claim 3, further comprising a pliable elongated member coupled to the latch member, wherein manual manipulation of the releasing member includes manually pulling the pliable elongated member.

5. The door-latching system of claim 1, wherein the latch member moves substantially linearly between the maintained release position and the door-blocking position.

6. The door-latching system of claim 5, wherein the sensing member is pivotally mounted within the latch assembly.

7. The door-latching system of claim 6, wherein the traveling member includes a pivotal arm that engages the sensing member as the plurality of door panels move from the closed position to the open position.

8. The door latching system of claim 7, wherein pivotal movement of the sensing member provides the motive force for actuating the latch member to the door-blocking position.

9. The door-latching system of claim 1, wherein the latch member and the sensing member comprise a latch assembly.

10. The door-latching system of claim 1, wherein the sensing member is an electric switch.

11. The door-latching system of claim 1, wherein the sensing member is a photoelectric eye.

12. The door-latching system of claim 1, wherein the sensing member is a proximity switch.

13. The door-latching system of claim 9, further comprising a second latch assembly mountable adjacent to the sectional door, wherein the second latch assembly engages the traveling member in response to the plurality of door panels moving to the closed position, thereby inhibiting the door panels from moving to the open position.

14. The door-latching system of claim 1, wherein the plurality of the door panels upon moving from the closed position to the open position exerts a motive force that moves the latch member from the maintained release position to the door-blocking position.

15. A door-latching system for a sectional door having a plurality of door panels that are moveable between an open position and a closed position, comprising:

a latch assembly mountable adjacent to the sectional door and comprising a latch member and a sensing member, the latch member having a maintained release position and a door-blocking position, wherein the door-blocking position allows less downward movement of the plurality of door panels than does the maintained release position; and a traveling member mountable to the plurality of door panels such that the traveling member is able to move past the latch member without contacting the latch member while still being able to engage the sensing member as the plurality of door panels move from the closed position to the open position, wherein the traveling member engaging the sensing member mechanically moves the latch member from the maintained release position to the door-blocking position.

16. The door-latching system of claim 15, wherein the latch member in the door-blocking position obstructs downward movement of the plurality of door panels by engaging a guide roller associated with the sectional door.

17. The door-latching system of claim 15, further comprising a releasing member coupled to the latch assembly, such that the releasing member moves the latch member from the door-blocking position to the maintained release position upon manual manipulation of the releasing member.

18. The door-latching system of claim 17, further comprising a pliable elongated member coupled to the latch assembly, wherein manual manipulation of the manual actuator includes manually pulling the pliable elongated member.

19. The door-latching system of claim 15, wherein the latch member moves substantially linearly between the maintained release position to the door-blocking position.

20. The door-latching system of claim 15, wherein the sensing member is pivotally mounted within the latch assembly.

21. The door-latching system of claim 15, wherein the latch assembly includes an actuating member pivotally mounted within the latch assembly.

22. The door-latching system of claim 21, wherein the sensing member is coupled to the actuating member such that engagement between the traveling member and the sensing member as the plurality of door panels move from the closed position to the open position causes the actuating member to move the latch member to the door-blocking position.

23. The door-latching system of claim 22, wherein the actuating member is the sensing member.

24. The door-latching system of claim 20, wherein the sensing member is an actuating member for moving the latch assembly to the door-blocking position.

25. The door-latching system of claim 15, wherein the traveling member is pivotally mountable to the plurality of door panels.

26. The door-latching system of claim 15, further comprising a second latch assembly mountable adjacent to the sectional door, wherein the second latch assembly engages the traveling member in response to the plurality of door panels moving to the closed position, thereby inhibiting the door panels from moving to the open position.

27. A method of operating a sectional door that includes a plurality of door panels moveable between an open position and a closed position, and a latch assembly with a latch member and a sensing member, wherein the latch member is moveable between a release position and a door-blocking position, the method comprising:

maintaining the latch member at its release position such that a traveling member mounted to the plurality of door panels does not contact the latch member while the plurality of door panels move from their closed position toward their open position; and subsequently mechanically moving the latch member to its door-blocking position in response to the traveling member engaging the sensing member as the plurality of door panels move from the closed position to the open position.

28. The method of claim 27, further comprising moving the latch member substantially linearly between the release position and the door-block position.

29. A door-latching system for a sectional door having a plurality of door panels that are moveable between an open position and a closed position, comprising:

a sensing member adapted to sense that the plurality of door panels have reached the open position;

a latch member moveable between a maintained release position and a door-blocking position, wherein the latch member in the maintained release position allows at least some of the plurality of door panels to travel past the latch member, and in the door-blocking position the latch member inhibits the plurality of door panels from moving from the open position to the closed position;

an actuating member that moves the latch member between the maintained release position and the door-blocking position in response to the sensing member having sensed that the plurality of door panels have reached the open position; and a traveling member mountable to the plurality of door panels, such that the traveling member is able to move past the latch member without contacting the latch member, while also being able to engage the sensing member as the plurality of door panels move from the closed position to the open position, wherein the traveling member engaging the sensing member mechanically moves the latch member from the maintained release position to the door-blocking position.

30. The door-latching system of claim 29, wherein the actuating member includes a solenoid.

31. The door-latching system of claim 29, wherein the actuating member is adapted to be pivotally mounted adjacent the sectional door.

32. The door latch system of claim 29, wherein the actuating member and the sensing member are adapted to be pivotally mounted adjacent the sectional door at a common pivot point.

33. The door latch system of claim 29, wherein the latch member moves linearly between the maintained release position and the door-blocking position.

34. The door latch system of claim 29, wherein the sensing member is an electric switch.

35. The door latch system of claim 29, wherein the sensing member is a photoelectric eye.

36. The door latch system of claim 29, wherein the sensing member is a proximity switch.

37. The door-latching system of claim 29, wherein the traveling member is able to engage the sensing member as the plurality of door panels move from the closed position to the open position, wherein the traveling member engaging the sensing member triggers movement of the latch member from the maintained release position to the door-blocking position.

38. The door-latching system of claim 29, wherein the latch member in the door-blocking position obstructs downward movement of the plurality of door panels by engaging a guide roller associated with the section door.

39. The door-latching system of claim 29, further comprising a releasing member coupled to the latch member, such that the releasing member moves the latch member from the door-blocking position to the maintained release position upon manual manipulation of the releasing member.

40. The door-latching system of claim 39, further comprising a pliable elongated member coupled to the latch member, wherein manual manipulation of the releasing member includes manually pulling the pliable elongated member.

41. The door-latching system of claim 29, wherein the latch member moves from the maintained release position to the door-blocking position in response to movement of the sensing member.

42. The door-latching system of claim 41, wherein the sensing member is the actuating member.

43. The door-latching system of claim 29, further comprising a second latch assembly mountable adjacent to the sectional door, wherein the second latch assembly engages the traveling member in response to the plurality of door panels moving to the closed position, thereby inhibiting the door panels form moving to the open position.

44. The door-latching system of claim 29, wherein the plurality of the door panels upon moving from the closed position to the open position exerts a motive force that moves the latch member from the maintained release position to the door-blocking position.

45. The door-bitching system of claim 44, wherein the actuating member transmits the motive force from the door panels to the latch member.

46. A method of operating a sectional door that includes a plurality of door panels moveable between an open position and a closed position, and a latch assembly that includes a latch member and a sensing member, wherein the latch member is moveable between a maintained release position and a door-blocking position, the method comprising:

maintaining the latch member in a retracted position such that a traveling member can move past the latch member without contact with it as the plurality of door panels move from the closed position to the open position;

sensing that the plurality of door panels have reached the open position in response to the traveling member engaging the sensing member as the plurality of door panels move from the closed position to the open position;

mechanically actuating the latch member such that the latch member mechanically moves from the maintained release position to the door-blocking position upon sensing that the plurality of door panels have reached the open position; and latching the sectional door upon actuating the latch member, whereby the latch member inhibits the plurality of door panels from moving from the open position to the closed position.

47. The method of claim 46, wherein the step of latching, the latch member engages a guide roller associated with the sectional door.

48. The method of claim 46, further comprising releasing the sectional door after the step of latching the sectional door, whereby the plurality of door panels are subsequently allowed to move from the open position to the closed position.

49. The method of claim 46, wherein movement or the plurality of door panels from the closed position to the open position provides a motive force for actuating the latch member.

* * * * *

UNITED STATES PATENT AND TRADEMARK OFFICE

CERTIFICATE OF CORRECTION

PATENT NO. : 7,114,753 B2
APPLICATION NO. : 09/781038
DATED : October 3, 2006
INVENTOR(S) : Nodorft It is certified that error appears in the above-identified patent and that said Letters Patent is hereby corrected as shown below:

Col. 10, line 48 After "The" delete "door-bitching" and insert -- door-latching --.

Col. 12, line 6 After "wherein movement" delete "or" and insert -- of --.

Signed and Sealed this

Nineteenth Day of December, 2006

JON W. DUDAS
*Director of the United States Patent and Trademark Office*